US005764198A

United States Patent [19]

Tsuru et al.

[11] Patent Number: 5,764,198

[45] Date of Patent: Jun. 9, 1998

[54] CHIP ANTENNA

[75] Inventors: Teruhisa Tsuru, Kameoka; Harufumi Mandai, Takatsuki; Seiji Kanba, Otsu; Kenji Asakura, Shiga-ken, all of Japan

[73] Assignee: Murata Manufacturing Co. Ltd., Kyoto, Japan

[21] Appl. No.: 717,491

[22] Filed: Sep. 20, 1996

[30] Foreign Application Priority Data

Sep. 25, 1995 [JP] Japan ..... 7-246292

[51] Int. Cl.[6] ..... H01Q 1/24; H01Q 1/36

[52] U.S. Cl. ..... 343/895; 343/702; 343/873

[58] Field of Search ..... 343/895, 702, 343/700 MS, 722, 749, 752, 872, 873; H01Q 1/24, 1/36

[56] References Cited

U.S. PATENT DOCUMENTS

| | | | |
|---|---|---|---|
| 3,925,784 | 12/1975 | Phelan | 343/895 |
| 4,646,366 | 3/1987 | Scholz | 343/895 |
| 5,627,551 | 5/1997 | Tsuru et al. | 373/700 MS |

FOREIGN PATENT DOCUMENTS

| | | |
|---|---|---|
| 8502719 | 6/1985 | WIPO . |
| 9312559 | 6/1993 | WIPO . |
| 9413029 | 6/1994 | WIPO . |

OTHER PUBLICATIONS

Patent Abstracts of Japan, vol. 13, No. 416 (E–821), Sep. 14, 1989 & JP 01 154605 A (Coil Suneeku K.K.), Jun. 16, 1989.

Patent Abstracts of Japan, vol. 8, No. 44 (E–229), Feb. 25, 1984 & JP 58 198902 A (TDK K.K.), Nov. 19, 1983.

*Primary Examiner*—Hoanganh T. Le

*Attorney, Agent, or Firm*—Ostrolenk, Faber, Gerb & Soffen, LLP

[57] ABSTRACT

A chip antenna comprising a rectangular substrate essentially comprising barium oxide, aluminum oxide and silica; a conductor which is formed inside the substrate and spiralled along the longitudinal direction thereof; a feeding terminal provided on the side and bottom faces of the substrate so as to apply a voltage to the conductor; and a grounding terminal which is provided on the side and bottom faces of the substrate and connects to a grounding electrode on a mounting board at the time of packaging. One end of the conductor forms a feeding end connecting to the feeding terminal and the other end forms a free end in the substrate. Capacitance is generated between a portion of the conductor and the grounding terminal.

23 Claims, 7 Drawing Sheets

CHIP ANTENNA

BACKGROUND OF THE INVENTION

1. Field of the Invention

The present invention relates to chip antennas. In particular, the present invention relates to chip antennas used for mobile communication and local area networks (LAN).

2. Description of the Related Art

FIG. 14 shows a sectional view of a conventional chip antenna 50 comprising the following components: a rectangular insulator 51, composed of laminated insulating layers (not shown in the figure) essentially comprising a powder of an insulating material, such as alumina and steatite; a spiral conductor 52 formed inside the insulator 51 from silver, silver-palladium, etc.; a magnetic member 53 formed inside the insulator 51 and the spiral conductor 52 from a powder of an insulating material, such as ferrite; external connecting terminals 54*a* and 54*b* welded to the lead end (not shown in the figure) of the conductor 52 after sintering the insulator 51.

However, in conventional chip antennas, such as described above, the resonance frequency and the impedance of the chip antenna vary from the predetermined value when the chip antenna is packaged in a mounting board because of the influences of a material of the mounting board, the shape of the grounding pattern of the substrate, the material of a cylindrical body having the chip antenna therein, and the like. Although the resonance frequency of a chip antenna can be preadjusted by taking the discrepancy into consideration beforehand, it is impossible to preadjust the impedance.

To solving the above problems, the present invention is aimed at providing a chip antenna maintaining a predetermined impedance.

SUMMARY OF THE INVENTION

Accordingly, a chip antenna which comprises a substrate comprising at least one material of a dielectric material and a magnetic material; a conductor provided on at least one side of the surface of the substrate and inside the substrate; at least one feeding terminal provided on the surface of the substrate for applying a voltage to the conductor; and at least one grounding terminal provided on the surface of the substrate.

It is another object of the present invention to provide a chip antenna, wherein at least one grounding pattern connecting to the grounding terminal is provided inside the substrate.

Further, it is another object of the present invention to provide a chip antenna, wherein at least one capacitor pattern connecting to the conductor is provided inside the substrate.

According to a chip antenna of the present invention, capacitance is generated between a conductor and a grounding terminal by setting up at least one conductor on at least one side of the surface and the inside of a substrate and by providing the grounding terminal on the surface of the substrate.

Further, by providing at least one grounding pattern connecting to a grounding terminal inside a substrate, capacitance is generated between a conductor and the grounding pattern.

Furthermore, by providing at least one capacitor pattern connecting to a conductor inside a substrate, capacitance is generated between the capacitor pattern and a grounding electrode.

Other features and advantages of the present invention will become apparent from the following description of the invention which refers to the accompanying drawings.

DETAILED DESCRIPTION OF EMBODIMENTS OF THE INVENTION

The present invention will be better understood from the following embodiments taken in conjunction with the accompanying drawings. The numerals in the different views identify substantially identical parts in the first embodiment, and detailed explanations thereof are omitted.

Figure 1:
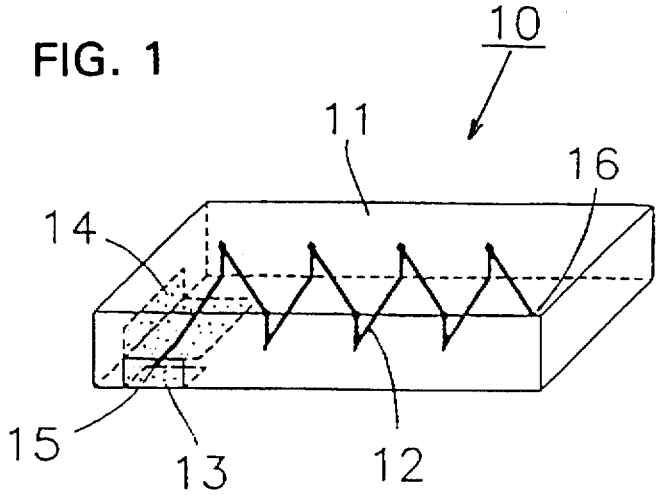
FIG. 1 is a perspective view illustrating a chip antenna in accordance with the first embodiment of the present invention.
Figure 2:
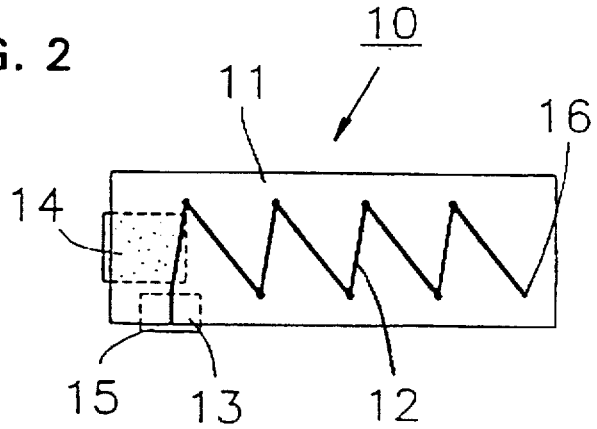
FIG. 2 is a plan view of the chip antenna shown in FIG. 1.
Figure 3:
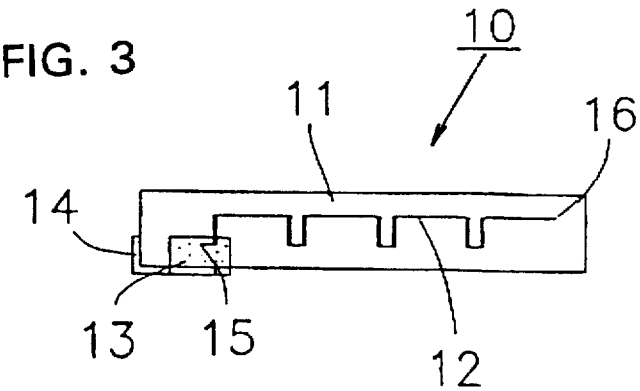
FIG. 3 is a sectional view of the chip antenna shown in FIG. 1.

FIGS. 1, 2 and 3 are respectively a perspective view, a plan view, and a sectional view of a chip antenna of the first embodiment in accordance with the present invention.

A chip antenna 10 comprises a rectangular substrate 11 formed from a dielectric material essentially comprising barium oxide, aluminum oxide and silica; a conductor 12 which is formed inside the substrate 11 from copper or a copper compound and spiralled along the longitudinal direction thereof; a feeding terminal 13 provided on the side and bottom faces of the substrate 11 so as to apply a voltage to the conductor 12; and a grounding terminal 14 which is provided on the side and bottom faces of the substrate 11 and connects to a grounding electrode on a mounting board (not shown in the figure) at the time of packaging. One end of the conductor 11 forms a feeding end 15 connecting to the feeding terminal 13 and the other end forms a free end 16 in the substrate 11.

When the conductor 12 passes nearby the grounding terminal 14, capacitance is generated between a portion of the conductor 12 and the grounding terminal 14.

As above mentioned, in the first embodiment, capacitance can be produced between a portion of a conductor and a grounding terminal by providing the conductor inside a substrate and by setting up the grounding terminal on the surface of the substrate. It becomes thereby possible to achieve the impedance in the desired center frequency and attain the desired bandwidth.

Figure 4:
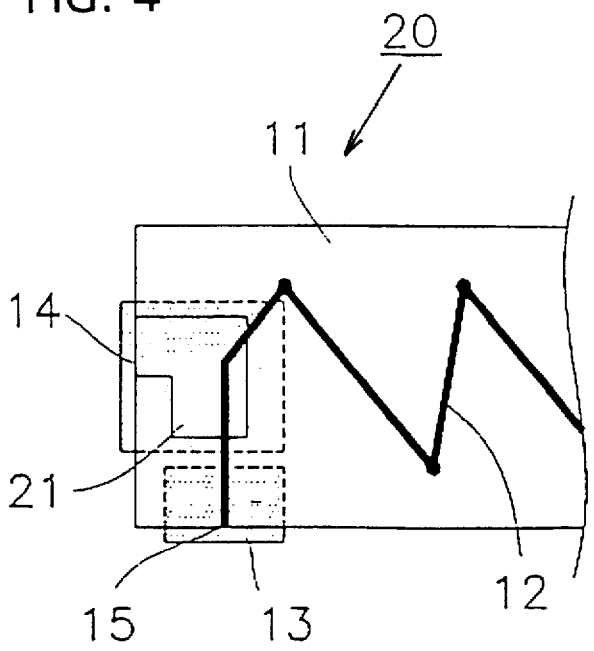
FIG. 4 is a partial plan view of a chip antenna in accordance with the second embodiment of the present invention.
Figure 5:
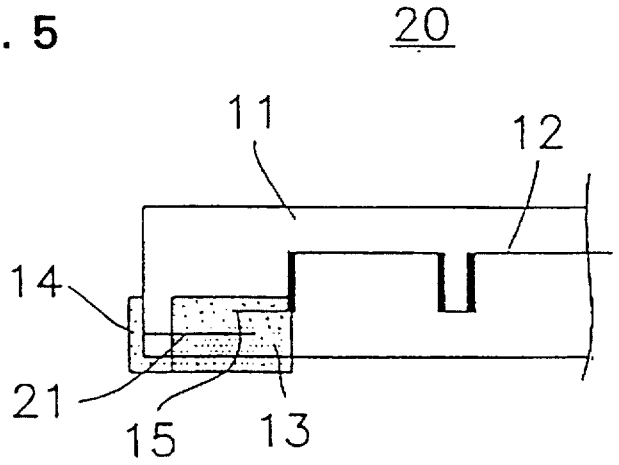
FIG. 5 is a fragmentary sectional view of the chip antenna shown in FIG. 4.

FIGS. 4 and 5 are respectively a partial plan view and a fragmentary sectional view of a chip antenna of the second embodiment in accordance with the present invention.

A chip antenna 20 comprises a rectangular substrate 11 formed from a dielectric material essentially comprising barium oxide, aluminum oxide and silica; a conductor 12 which is formed inside the substrate 11 from copper or a copper compound and spiralled along the longitudinal direction thereof; a feeding terminal 13 provided on the side and bottom faces of the substrate 11 so as to apply a voltage to the conductor 12; a grounding terminal 14 which is provided on the side and bottom faces of the substrate 11 and connects to a grounding electrode on a mounting board (not shown in the figure) at the time of packaging; and a grounding pattern 21 which is formed inside the substrate 11 and connects to the grounding terminal 14. Similarly to the chip antenna 10 shown in FIG. 1, one end of the conductor 12 forms a feeding end 15 connecting to the feeding terminal 13 and the other end forms a free end (not shown in the figure) in the substrate 11.

Capacitance is generated between a portion of the conductor 12 and the grounding terminal 14, and also, between a portion of the conductor 12 and the grounding pattern 21.

As above mentioned, in the second embodiment, since a grounding pattern is provided inside a substrate, larger capacitance can be produced by increasing the area of the grounding pattern. Therefore, it is possible to obtain larger capacitance without increasing the area of a grounding terminal set up on the substrate surface. As a result, the impedance in the center frequency becomes adjustable even if the discrepancy of the frequency is significantly large, and further, the desired bandwidth can be reliably attained with accuracy.

Figure 6:
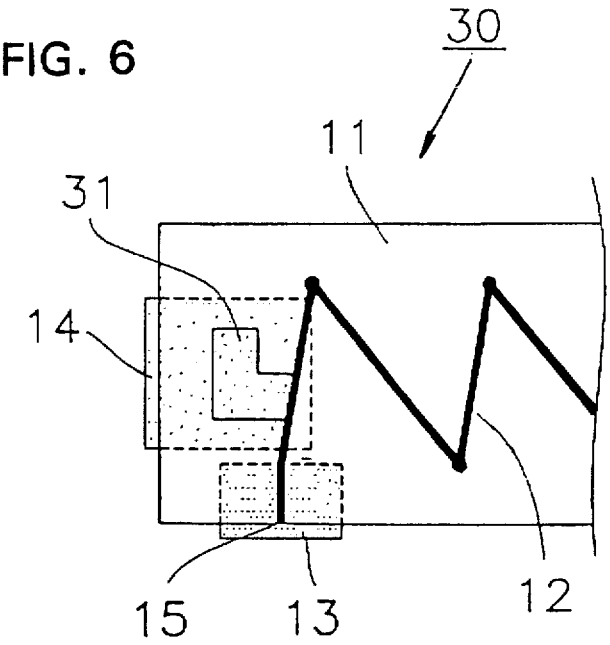
FIG. 6 is a partial plan view of a chip antenna in accordance with the third embodiment of the present invention.
Figure 7:
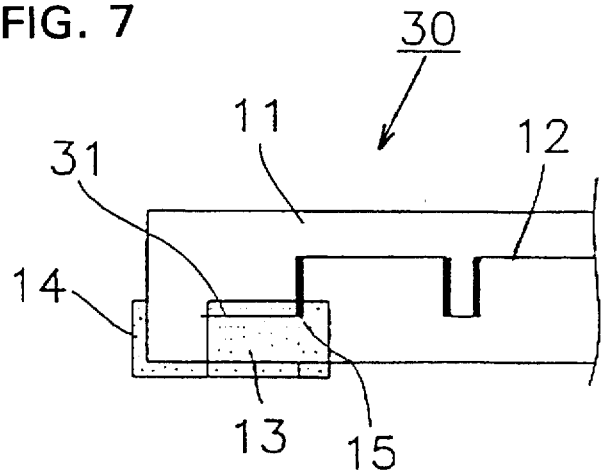
FIG. 7 is a fragmentary sectional view of the chip antenna shown in FIG. 6.

FIGS. 6 and 7 are respectively a partial plan view and a fragmentary sectional view of a chip antenna of the third embodiment in accordance with the present invention.

A chip antenna 30 comprises a rectangular substrate 11 formed from a dielectric material essentially comprising barium oxide, aluminum oxide and silica; a conductor 12 which is formed inside the substrate 11 from copper or a copper compound and spiralled along the longitudinal direction thereof; a feeding terminal 13 provided on the side and bottom faces of the substrate 11 so as to apply a voltage to the conductor 12; a grounding terminal which is provided on the side and bottom faces of the substrate 11 and connects to a grounding electrode on a mounting board (not shown in the figure) at the time of packaging; and a capacitor pattern 31 which is formed inside the substrate 11 and connects to the conductor 12. Similarly to the chip antenna 10 shown in FIG. 1, one end of the conductor 11 forms a feeding end 15 connecting to the feeding terminal 13 and the other end forms a free end (not shown in the figure) in the substrate 11.

Capacitance is generated between a portion of the conductor 12 and the grounding terminal 14 and, also, between the capacitor pattern 31 and the grounding terminal 14.

As above mentioned, in the third embodiment, since a capacitor pattern is provided inside a substrate, capacitance can be controlled more readily and accurately by determining the area of the capacitor pattern. As a result, it becomes easier to precisely adjust the impedance in the center frequency, and further, the desired bandwidth can be reliably attained with accuracy.

Figure 8:
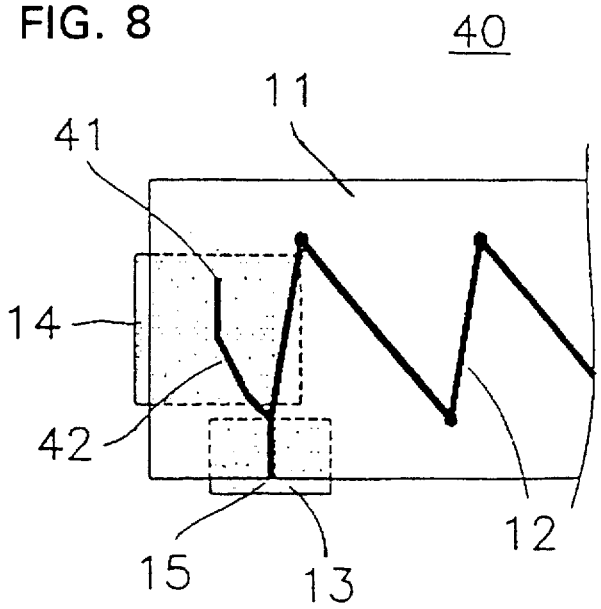
FIG. 8 is a partial plan view of a chip antenna in accordance with a modified embodiment of the present invention.

FIG. 8 shows a partial plan view of a modified example of a chip antenna 40 incorporated into the present invention. The chip antenna 40 differs from the chip antenna 10 of the first embodiment in the following respects: an attached portion 42 is provided for the chip antenna 40 such that one end thereof connects to a feeding end 15 of a conductor 12 and the other end forms a free end in a substrate 11; and capacitance is generated between a grounding terminal 14 and the attached portion 42, in addition to between a portion of the conductor 12 and the grounding terminal 14.

Figure 9:
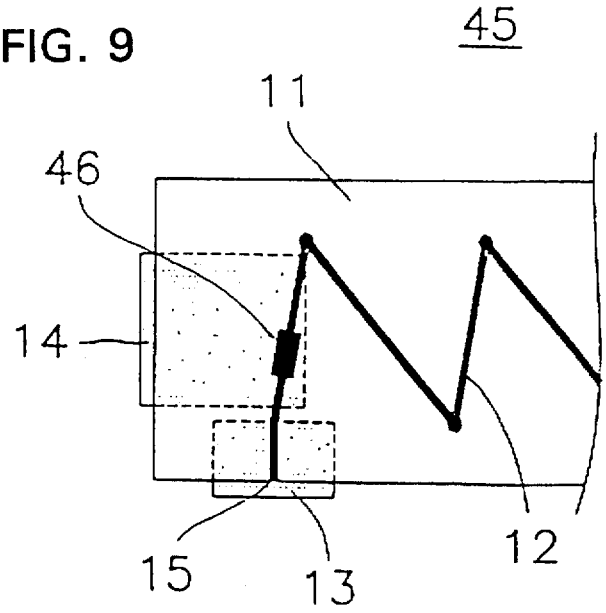
FIG. 9 is a partial plan view of a chip antenna in accordance with another modified embodiment of the present invention.
Figure 14:
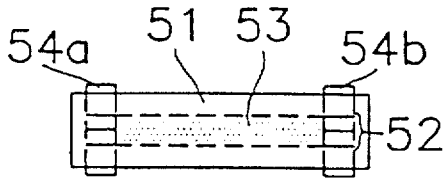
FIG. 14 PRIOR ART
FIG. 14 is a sectional view of a conventional chip antenna.

FIG. 9 shows a partial plan view of a modified example of a chip antenna 45 incorporated into the present invention. The chip antenna 45 differs from the chip antenna 10 of the first embodiment such that an extending portion 46 is provided for a portion of a conductor 12 and capacitance is generated between a grounding terminal 14 and the extending portion 46, in addition to between a portion of the conductor 12 and the grounding terminal 14.

As above mentioned, in the forgoing modified embodiments, capacitance is generated between a grounding terminal and an attached portion or an extending portion provided for a conductor, thus capacitance can be controlled more readily and accurately by determining the area of the attached portion or that of the extending portion. As a result, it becomes easier to precisely adjust the impedance in the center frequency, and further, the desired bandwidth can be reliably attained with accuracy.

Moreover, the forgoing modified embodiments can be applied to the second and third embodiments. The attached portion 42 or the extending portion 46 may be set up in an opposite position to the grounding pattern 21 when either of the modified embodiments is applied to the second embodiment.

Figure 10:
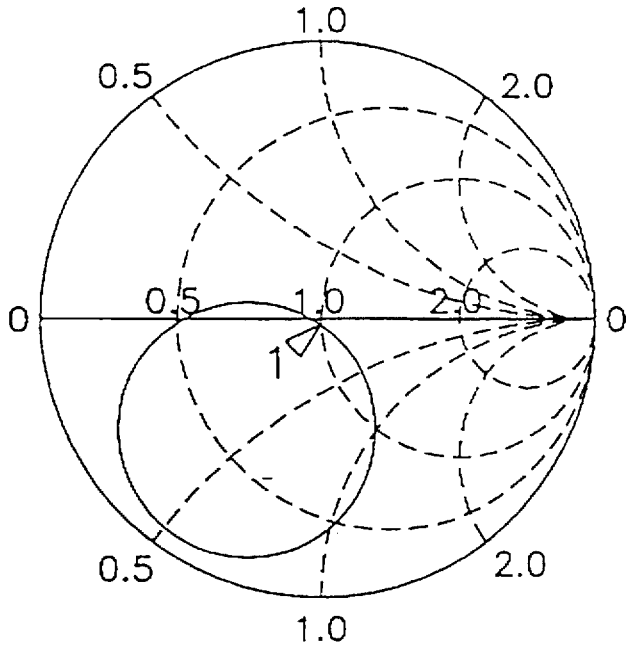
FIG. 10 shows the impedance characteristics of the chip antenna shown in FIG. 6 when capacitance of 2 pF is generated therein.
Figure 11:
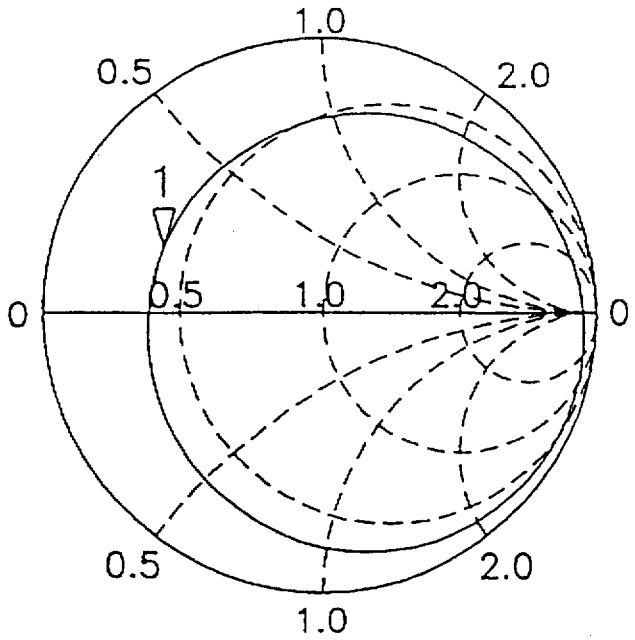
FIG. 11 shows the impedance characteristics of a conventional chip antenna.
Figure 12:
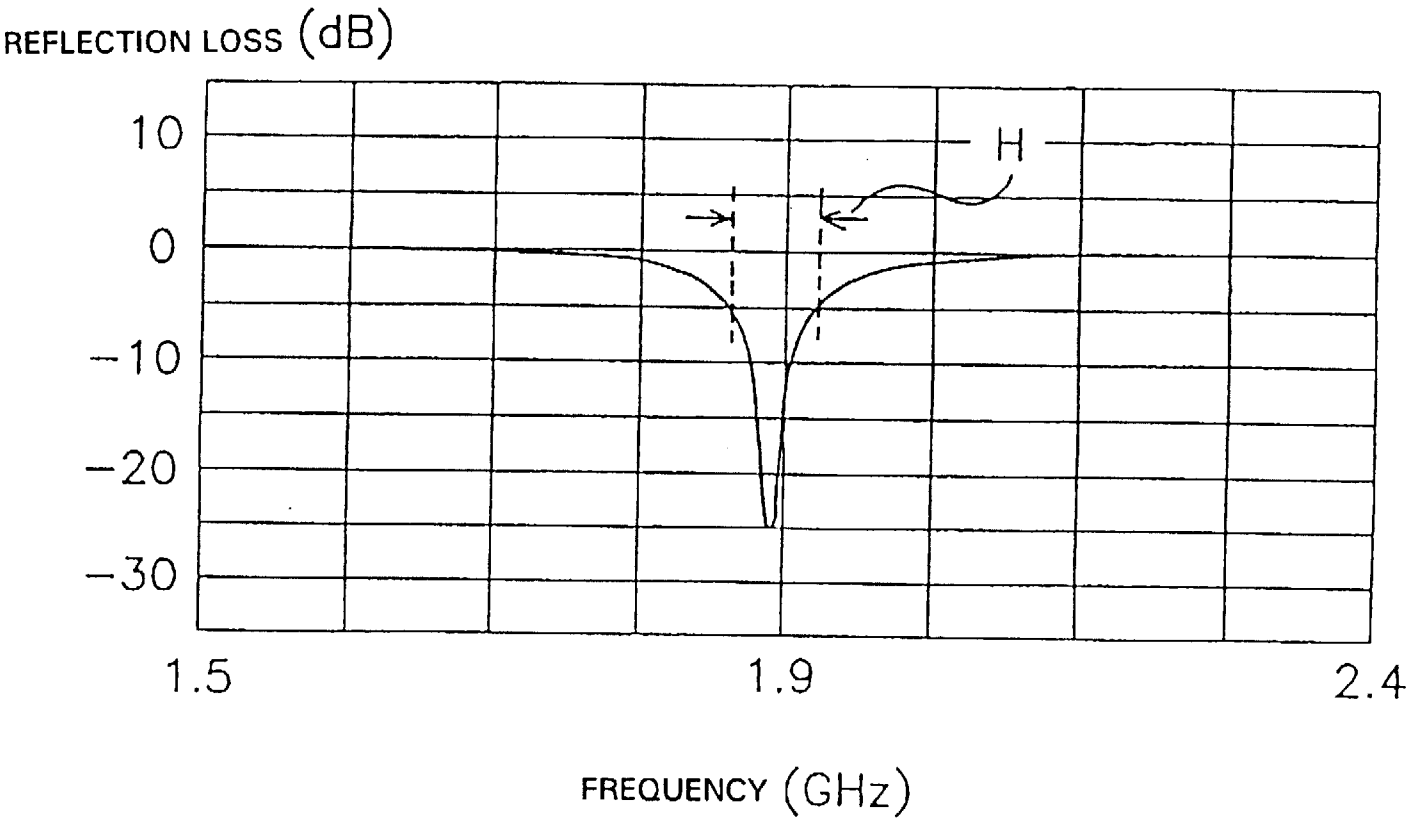
FIG. 12 shows the reflection loss characteristics of the chip antenna shown in FIG. 6 when capacitance of 2 pF is generated therein.
Figure 13:
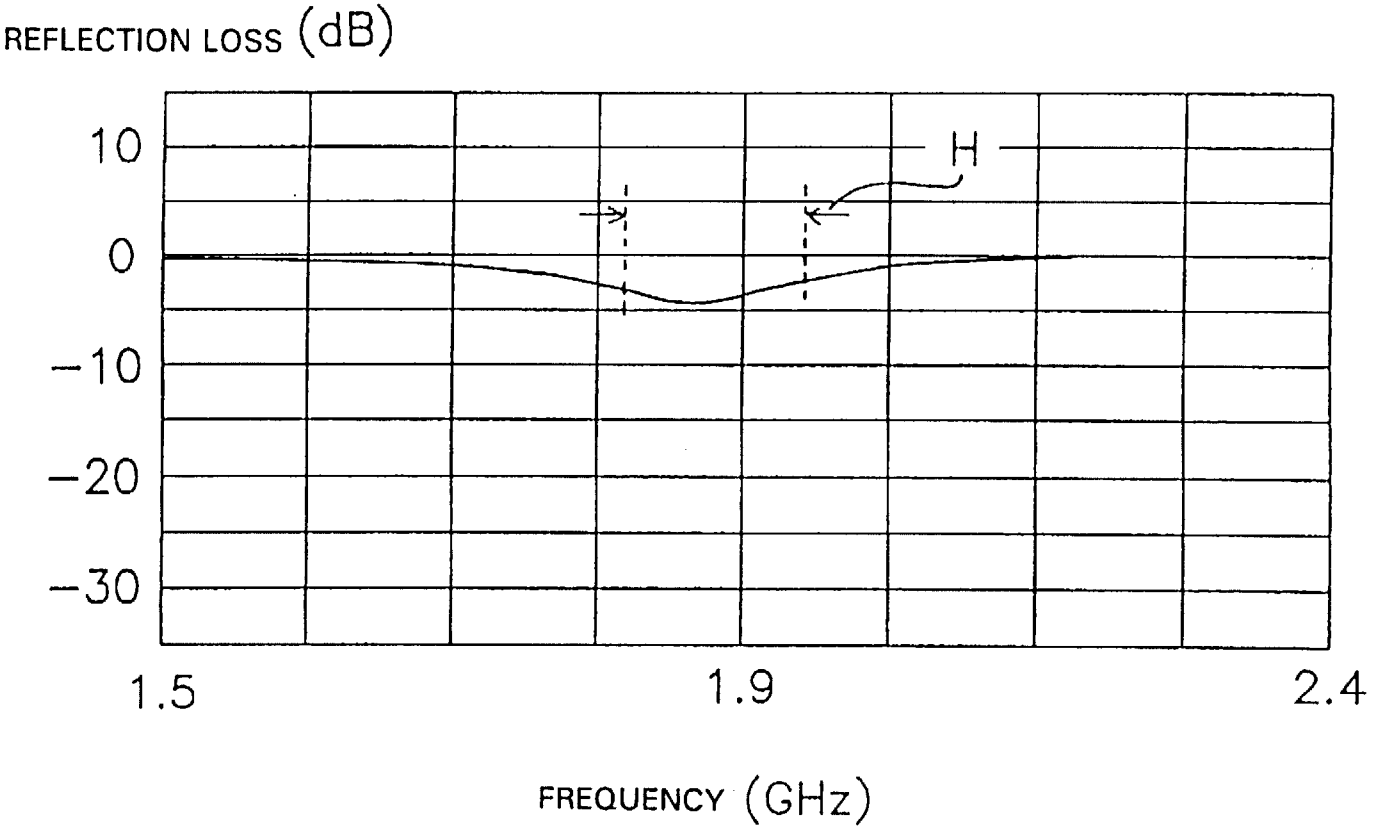
FIG. 13 shows the reflection loss characteristics of a conventional chip antenna.

FIG. 10 shows the impedance characteristics of the chip antenna. FIG. 12 practically indicates the reflection loss characteristics thereof. FIGS. 10 and 12 show the characteristics of the chip antenna 30 illustrated in FIG. 6 in which capacitance of 2 pF is generated. FIGS. 11 and 13 show the characteristics of a conventional chip antenna in which no capacitance is generated.

Table 1 shows the impedance in the center frequency (1.9 GHz: the arrow 1 in the center of each figure) obtained from FIGS. 10 and 11, and the bandwidth (the region of H shown in each figure) obtained from FIGS. 12 and 13.

TABLE 1

| | Center frequency impedance (Ω) | Bandwidth of chip antenna (MHz) |
|---|---|---|
| Chip antenna of FIG. 6 capacitance: 2 (pF) | 49.58 | 57.3 |
| Conventional chip antenna capacitance: 0 (pF) | 12.99 | 123.5 |

It is understood from the results shown in Table 1 that, in the chip antenna 30, the impedance in the center frequency is adjusted to approximately 50 Ω and the bandwidth can be controlled by generating capacitance of 2 pF.

The formula of the integrity condition for connecting the chip antenna 30 having base impedance of Za (Za=Ra−jXa) and a coaxial feeder having input impedance of RO through a matching circuit is as follows:

$$C=(1/wR0)\{(Z0-Ra)/Ra\}^{1/2}$$

The following formula is derived from the above formula:

$$Z0=\{(wR0C)2+1\}Ra$$

In the above, Z0 is the impedance in the center frequency, Ra is the inductance of the conductor 12, and C is the capacitance between the conductor 12 and the grounding terminal 14 and between the capacitor pattern 41 and the grounding terminal 14. It is also understood from these formulae that the impedance in the center frequency can be controlled by generating capacitance.

Although in the first to the third embodiments, the substrate is made from a dielectric material essentially comprising barium oxide, aluminum oxide and silica, it is not limited thereto. Dielectric materials essentially comprising titanium oxide and neodymium oxide, magnetic materials essentially comprising nickel, cobalt and iron, or a combination thereof, may be used as a material for the substrate. Examples of a material used for a conductor are as follows: copper, copper alloys, nickel, nickel alloys, platinum, platinum alloys, silver, silver alloys, and silver-palladium alloys. Other conductive materials can be used.

In the first to the third embodiments, a spiral conductor is formed inside a substrate of a chip antenna. However, the spiral conductor may be formed on at least one side of the surface of the substrate and inside the substrate. Further, a meander conductor may be formed on at least one side of the surface and the inside of the substrate.

Moreover, in the second and third embodiments, larger capacitance is generated because a grounding pattern and a capacitor pattern can be set up in multi-layers. Therefore, if the required capacitance is the same, a smaller-size chip antenna can be used.

The positions of the feeding terminal and the grounding terminal as shown in the drawings are not essential for the practice of the present invention.

According to a chip antenna of the first aspect of the present invention, capacitance is generated between a portion of a conductor and a grounding terminal by setting up the conductor on at least one side of the surface and the inside of the substrate and by providing the grounding terminal on the surface of the substrate. The impedance in the desired center frequency is thereby obtained and, further, the desired bandwidth can be attained.

According to a chip antenna of the second aspect of the present invention, since a grounding pattern is provided inside a substrate, larger capacitance can be produced by increasing the area of the grounding pattern. Therefore, it is possible to obtain larger capacitance without increasing the area of the grounding terminal set up on the substrate surface. As a result, the impedance in the center frequency becomes adjustable even if the discrepancy of the frequency is significantly large and, further, the desired bandwidth can be reliably attained with accuracy.

According to a chip antenna of the third aspect of the present invention, since a capacitor pattern is provided inside a substrate, capacitance can be controlled more easily and accurately by determining the area of the capacitor pattern. As a result, it becomes easier to precisely adjust the impedance in the center frequency, and further, the desired bandwidth can be reliably attained with accuracy.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a substrate comprising at least one of a dielectric material and a magnetic material;

a conductor provided inside said substrate;

at least one feeding terminal provided on the surface of said substrate for applying a voltage to said conductor; and at least one grounding terminal provided on the surface of said substrate, a capacitance being formed between the grounding terminal and the conductor.

2. A chip antenna according to claim 1, wherein at least one grounding pattern connecting to said grounding terminal is provided inside said substrate.

3. A chip antenna according to claim 2, wherein at least one capacitor pattern connecting to said conductor is provided inside said substrate.

4. A chip antenna according to claim 2, wherein the size of the grounding pattern can be adjusted to adjust the impedance of the chip antenna.

5. A chip antenna according to claim 2, wherein the grounding pattern connecting to the grounding terminal is disposed near the grounding terminal.

6. A chip antenna according to claim 1, wherein at least one capacitor pattern connecting to said conductor is provided inside said substrate.

7. A chip antenna according to claim 6, wherein the size of the capacitor pattern can be adjusted to adjust the impedance of said chip antenna.

8. A chip antenna according to claim 6, wherein the capacitor pattern is disposed near the grounding terminal.

9. A chip antenna according to claim 6, wherein the capacitor pattern comprises an attached portion of conductor connected to said conductor.

10. A chip antenna according to claim 6, wherein the capacitor pattern comprises an extending portion of said conductor.

11. A chip antenna according to claim 1, wherein the conductor is spiral shaped.

12. A chip antenna according to claim 1, wherein the conductor is disposed in a plane.

13. A chip antenna according to claim 12, wherein the conductor is a meander conductor.

14. A chip antenna according to claim 1, wherein the substrate comprises a dielectric material.

15. A chip antenna according to claim 14, wherein the dielectric material comprises at least one of barium oxide, aluminum oxide, silica, titanium oxide and neodymium oxide.

16. A chip antenna according to claim 1, wherein the substrate comprises a magnetic material.

17. A chip antenna according to claim 16, wherein the magnetic material comprises at least one of nickel, cobalt, iron and a combination thereof.

18. A chip antenna according to claim 1, wherein the substrate comprises a combination of a dielectric material and a magnetic material.

19. A chip antenna according to claim 1, wherein the conductor comprises one of nickel, a nickel alloy, platinum, a platinum alloy, copper, a copper alloy, silver, a silver alloy, and a silver-palladium alloy.

20. A chip antenna according to claim 1, further comprising a capacitance between a portion of the conductor and the grounding terminal.

21. A chip antenna according to claim 1, wherein the conductor has a free end.

22. A chip antenna comprising:

a substrate comprising at least one of a dielectric material and a magnetic material;

a conductor provided on at least one of a side of the surface of the substrate and inside the substrate;

at least one feeding terminal provided on the surface of said substrate for applying a voltage to said conductor;

at least one grounding terminal provided on the surface of said substrate; and at least one capacitance pattern electrode connected to said conductor and provided inside said substrate, a capacitance being formed between said grounding terminal and said capacitance pattern electrode.

23. A chip antenna according to claim 22, wherein a grounding pattern connected to said grounding terminal is provided inside said substrate, said capacitance being formed between said capacitance pattern electrode and said grounding pattern.

* * * * *